US005748079A

United States Patent [19]

Addy

[11] Patent Number: 5,748,079

[45] Date of Patent: May 5, 1998

[54] ALARM COMMUNICATIONS SYSTEM WITH INDEPENDENT SUPERVISION SIGNAL ANALYSIS

[75] Inventor: Kenneth L. Addy, Massapequa, N.Y.

[73] Assignee: Pittway Corporation, Chicago, Ill.

[21] Appl. No.: 685,716

[22] Filed: Jul. 24, 1996

Related U.S. Application Data

[63] Continuation-in-part of Ser. No. 650,292, May 20, 1996.

[51] Int. Cl.[6] ..... G08B 1/08

[52] U.S. Cl. ..... 340/539; 340/506; 340/514

[58] Field of Search ..... 340/539, 506, 340/514, 825.69, 825.06, 825.72; 364/138, 140, 141

[56] References Cited

U.S. PATENT DOCUMENTS

| | | | |
|---|---|---|---|
| 4,101,872 | 7/1978 | Pappas | 340/539 |
| 4,191,948 | 3/1980 | Stockdale | 340/539 |
| 4,367,458 | 1/1983 | Hackett | 340/539 |
| 4,442,426 | 4/1984 | Heuschmann et al. | 340/539 |
| 4,523,184 | 6/1985 | Abel | 340/539 |
| 4,672,365 | 6/1987 | Gehman et al. | 340/539 |

*Primary Examiner*—Donnie L. Crosland
*Attorney, Agent, or Firm*—Anthony R. Barkume, P.C.

[57] ABSTRACT

A self testing wireless data communications system suitable for use with an alarm system, the receiving element of the communications system is capable of receiving the message simultaneously at two different sensitivity levels, and during a supervision message, the lower sensitivity path is used in order to ensure that non-supervision alarm messages are received with an adequate signal margin.

13 Claims, 5 Drawing Sheets

ALARM COMMUNICATIONS SYSTEM WITH INDEPENDENT SUPERVISION SIGNAL ANALYSIS

CROSS REFERENCE TO RELATED APPLICATION

This application is a continuation-in-part of copending U.S. application Ser. No. 08/650,292, filed on May 20, 1996, which is incorporated by reference herein. This application is also related to copending U.S. application Ser. No. 08/685,539, entitled ALARM COMMUNICATIONS SYSTEM WITH SUPERVISION SIGNAL RSSI ANALYSIS, filed by the applicant on Jun. 24,1996.

BACKGROUND OF THE INVENTION

The present invention relates to communications devices and protocols such as those used in wireless alarm systems having multiple sensors in communication with one or more receiver/control units; and in particular to such alarm systems wherein the receiving unit of the system automatically provides an indication as to the signal strength of a transmitted supervision signal by providing simultaneous decoding of an incoming message signal at two different sensitivity levels. A message from a transmitter which is for supervision purposes is received and processed at a lower sensitivity level. An alarm message is always received at normal sensitivity level. This ensures that there is always adequate signal margin in the system and that alarm messages are not subject to reduction in sensitivity during a supervision self-test procedure.

Most radio frequency (RF) wireless security systems available today, such as those manufactured by ADEMCO, generally employ a multiplicity of transmitter products which transmit information to a common receiver/control. The information transmitted typically describes the state of various transducers associated with each transmitter, such as smoke, motion, breaking glass, shock and vibration detectors; door, window and floor mat switches; etc. These transmitter products are designed to be low in cost and are typically send-only devices, as opposed to send/receive, or transceiver, devices which are significantly more expensive. In order to meet basic regulatory agency requirements, the transmitters are required to transmit periodic supervision transmission signals in order for the control to monitor proper operation of all of the transmitters in a given system. The supervision signal (as well as an alarm signal) has a unique identification code embedded in its data message, which serves to identify to the system control which particular transmitting device has sent that supervision (or alarm) message. Typically, when a supervision signal is properly received and detected by the receiver unit, the transmitter identification code is supplied to the system control for further processing.

For life safety applications, the RF wireless system must also comply with more stringent regulations, such as the Underwriters Laboratories regulation UL864. This regulation additionally requires that the supervision signal be reduced in transmission power level below that of the alarm (normal, non-supervision) signal transmission by a minimum of 3 dB or by other equivalent means, to ensure that the alarm signal has an effective power margin over that of the periodic supervision signals from each transmitter in the system.

To employ transmitter-only products that would accurately transmit an alarm signal at the maximum allowable level and to reduce that power level by a minimum of 3 dB during the periodic supervision signal transmission would add significant additional cost to each transmitter product. Furthermore, most transmitter circuits were designed prior to the advent of the regulations such as the UL864 requirement, making it necessary to redesign and replace all of the transmitter circuits presently on the market despite the fact that they already meet all of the other applicable UL, FCC, and other regulatory requirements.

This problem is addressed by the inventors of copending application Ser. No. 08/650,292. In that application, the inventors describe a novel system wherein the receiver detects the reception of a supervision signal, and then modifies an operational parameter of the receiver, such as reducing the receiver sensitivity by 3 dB, for subsequent data reception. When the next message in the supervision signal pentad (which is five messages in a row) is detected at this reduced receiver sensitivity within a predetermined time, then that supervision signal is flagged as passing the margin test and the control is provided with the data message. If no next supervision signal received, then the first message is ignored and the control is not informed of its reception. Thus, if a transmitter is transmitting signals which do not provide the power margin over normal alarm signals as required by the regulations, then it is not accepted by the system.

If a message is received from a different transmitter while the receiver sensitivity is reduced, then it must be strong enough to pass the 3 dB reduction, even if it is not a supervision signal. The present invention has been implemented in order to provide automatic testing of the received supervision signal without modifying its receive sensitivity or other operational parameter for subsequent messages, but rather by performing such tests in real-time on the first detected supervision message.

It would therefore be advantageous to employ an alarm system which receives the system supervision messages at a sensitivity below a normal alarm signal and therefore ensures that the alarm signal has an effective margin over that of the periodic supervision messages from each transmitter in the system, without modification to the transmitters already in commercial use.

It is therefore an object of the present invention to provide a communications system suitable for use with an alarm system which provides for effectively reducing the supervision signal strength without modification of the supervision signal generated by the transmitting device.

It is a further object of the present invention to provide two signal paths within the receiver such that a supervision message may be received at a lower sensitivity level compared to the sensitivity at which the alarm messages are received.

It is still a further object of the present invention to provide for the logical prevention of the transmitter identification code from being sent to the system control during a supervision transmission from that transmitter if a supervision message is received at the high sensitivity level but is not properly received at the reduced sensitivity level.

It is still a further object of the present invention to provide for the logical allowance of the transmitter identification code to be sent to the system control if a supervision message is received at both the high and low sensitivity levels.

It is yet a further object of the present invention to ensure that alarm messages are always received and sent to the control system at the high sensitivity level.

It is still a further object to provide an effective method of differentiating between supervision and alarm transmissions.

It is still a further object of the present invention to provide a method of imposing a higher threshold for supervision messages, without requiring that the system employ a format wherein multiple messages are sent at each transmission event.

SUMMARY OF THE INVENTION

In accordance with these and other objects, the present invention is a data communications method and system comprising a plurality of remote devices comprising means for transmitting supervision signals and non-supervision signals, and a receiver providing means for receiving signals at two different sensitivity levels, the supervision signals being processed at a lower sensitivity level, and the alarm messages being processed at the normal sensitivity level.

In particular, the present invention is a method for automatically testing a communications system, wherein the communications system comprises a plurality of remote transmitting devices and a receiving station having a receiver associated therewith, and wherein each of the remote transmitting devices is capable of transmitting a supervision signal and a non-supervision signal. The method comprises the steps of receiving at the receiving station a signal from a transmitting device, processing the received signal at a first sensitivity level and providing a first output signal representative thereof, and processing the received signal at a second sensitivity level and providing a second output signal representative thereof, wherein the second sensitivity level is lower in magnitude than the first sensitivity level. It is then determined if the received signal is a supervision signal or a non-supervision signal by analyzing the first output signal. When the received signal is determined to be a supervision signal, then it is determined if the second output signal is correlated to the first output signal, and the first output signal is subsequently processed as being art of a validly received supervision signal when the second output signal is determined to be correlated to the first output signal, and the first output signal is not subsequently processed as being art of a validly received supervision signal when the second output signal is determined to be not correlated to the first output signal. When the received signal is determined to be a non-supervision signal, then the first output signal is subsequently processed as being part of a validly received non-supervision signal.

In one preferred embodiment, the remote devices and the receiving means communicate by radio frequency electromagnetic waves transmission and at least one alarm sensor is associated with each alarm transmitter.

Thus, the present invention is based on the premise that instead of reducing the radiated power of the transmitted periodic supervision signals, it is equivalent to receive supervision signals at reduced sensitivity while maintaining full sensitivity for alarm transmissions. This invention provides a unique method of accomplishing the stated objectives without compromising the integrity of alarm signals.

The first requirement of the receiver is that it have the ability to receive signals at two distinct sensitivity levels, at least 3 dB different to meet applicable regulatory agency requirements. The receiver implemented in the present invention uses a superheterodyne architecture, although those skilled in the art will recognize that all receiver types may be applied equally well in this invention. It is important to note that the receiver sensitivity is most cost-effectively controlled by means of introduction of a threshold or clipping level in the video processing circuitry after the incoming RF signal is demodulated and reduced to its original baseband content. The video processing circuit output is two identical baseband signals except that one of the signals has been subjected to a 3 dB higher threshold than the other. These two baseband signals are connected to input ports on a microprocessor, providing the microprocessor with two signal inputs which are received at different sensitivities. Those skilled in the art will recognize that control of sensitivity at baseband is the most cost effective method, although creation of two distinct paths at an earlier point in the receiver is possible albeit less desirable for reasons of cost and complexity.

The signal received at high sensitivity is used by the microprocessor to obtain timing and synchronization information during a preamble portion of the message, the timing information is then used by the microprocessor to clock-in the subsequent data and CRC portions of the message into both microprocessor input ports. The signal received into the reduced sensitivity port is stored in RAM in the microprocessor. The signal received at the high sensitivity port is checked for proper CRC and it is determined whether or not the message is of a supervision type. If the message is a non-supervision message then it is passed directly to the control panel for further processing. If the CRC is good and the message is a supervision type, then the stored data in RAM from the reduced sensitivity port are read and the CRC is computed, if it is correct, and is identical to (correlated with) the message received at the high sensitivity port, then this message is passed to the control for further processing. If the CRC does not compute or the stored message does not match the high sensitivity message, then the message is not processed any further, and the supervision transmission fails to be received.

DETAILED DESCRIPTION OF THE PREFERRED EMBODIMENT

Figure 1:
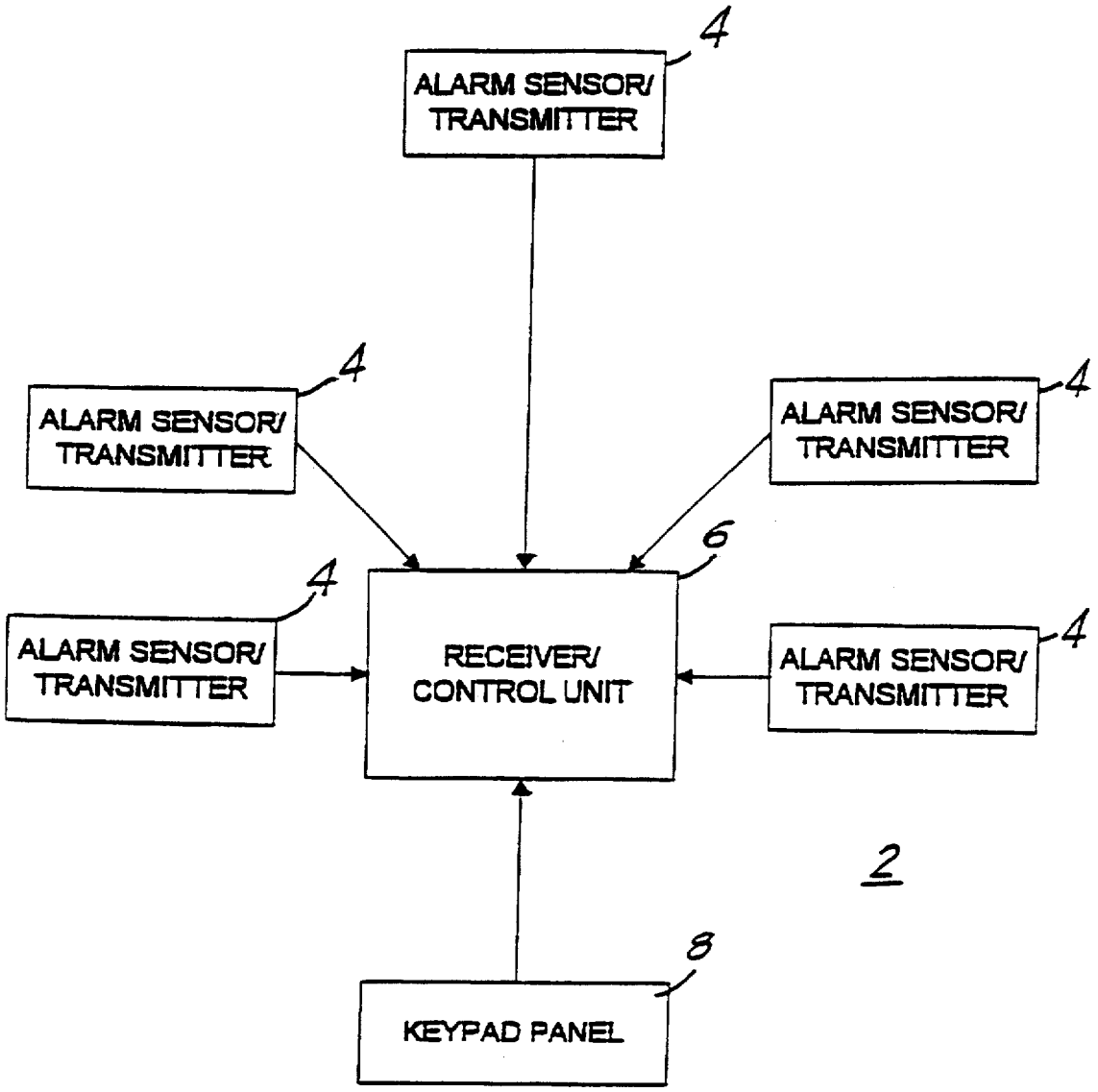
FIG. 1 is a block diagram of the preferred embodiment of the present invention.

Referring to FIG. 1, an alarm system 2 is shown, which includes a receiver/control unit 6 in communications with a plurality of remote devices 4, each of which comprise an alarm sensor and a data transmitting unit. The alarm sensors are well known in the prior art and include, for example, motion detectors, fire or smoke sensors, glass breakage sensors, door or window entry sensors, and the like. In the preferred embodiment, the alarm system 2 operates in a so-called "wireless" fashion by electromagnetic wave transmission (radio frequency in particular) between the remote devices 4 and the receiver/control unit 6. The transmitter units housed within each remote device 4 are also well known in the art, and transmit supervision and alarm message signals (non-supervision signals), to be described below, by modulating a high frequency RF signal (e.g. 345 MHz). The modulated RF signal is received, processed and decoded by the receiver/control unit 6 so that the control unit is provided with the data from the remote devices 4 and may act accordingly; e.g. by sounding an alarm speaker, dialing a police or fire station, etc. Further description of this type of wireless alarm system may be found in U.S. Pat. No. 4,754,261 to Marino, which is owned by the assignee of the present invention and is incorporated by reference herein.

The remote devices 4 are configured to transmit supervision signals and alarm signals in accordance with protocol known in the art. The supervision signals function to provide periodic "test" signals to the receiver/control unit 6 for the purpose of ensuring that each remote device 4 configured with the system 2 is in proper communication with the receiver/control unit 6. Since it is possible in this type of system that a remote device 4 may only transmit an alarm signal at a time of an emergency (i.e. when a window associated with the sensor is broken), it is imperative that the system 2 maintain a periodic method of ensuring that a device 4 is in proper communication with the receiver/control unit 6 so potential problems may be attended to promptly.

Thus, a supervision signal is periodically sent from each remote device 4 in the system to the receiver/control unit 6 for monitoring purposes. In the preferred embodiment, a supervision transmission sequence consists of a single pentad, which is a single group of five identical messages. Each message is approximately 20 ms in duration and is repeated every 100 ms. A normal, non-supervision alarm signal, which is transmitted typically only when a change in status of the alarm sensor occurs (e.g. when a door is opened), consists of a double pentad, which is two groups of five identical messages separated in time by approximately 1 second.

Figure 2:
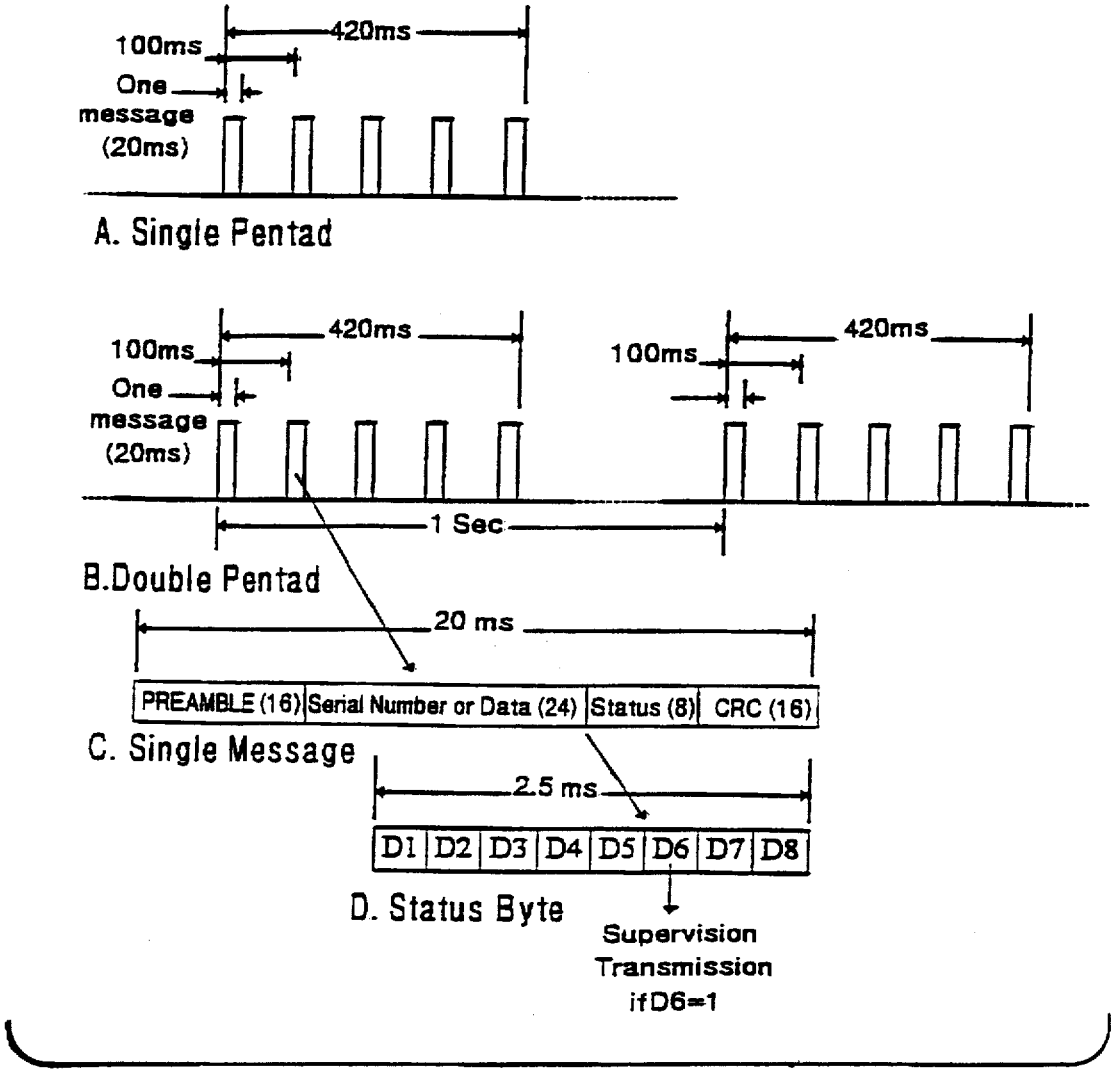
FIG. 2 is a timing diagram of alarm and transmission messages in the preferred embodiment.

Each identical message is 64 bits long and has a 16-bit preamble, 24 bits of transmitter serial number or keypad data, a single 8-bit status byte, and a 16-bit CRC (Cyclical Redundancy Character), as shown in FIG. 2. The status byte contains 8 data bits, shown as D1–D8 of FIG. 2, which convey specific information. In this embodiment, D8=1 signifies that the received message was from a transmitter which is capable of generating supervision transmissions, whereupon D1–D4 represent the state of up to 4 sensor inputs to that transmitter, D5 indicates the state of that transmitter's battery, and D6=1 indicates that the received message was part of a supervision single pentad transmission. In this manner, the receiver circuitry is provided with coded information from the transmitter unit which enables it to determine if the message is part of a supervision signal or part of a normal, non-supervision alarm signal.

During the preamble portion of a received message, the microprocessor decoding algorithm determines the necessary timing information required for subsequent decoding of the data portion and CRC of the message. This timing and initial decode is determined using the high sensitivity port of the microprocessor.

When the microprocessor in the receiver decodes a non-supervision (D6=0) message on the high sensitivity port it is immediately sent to the control panel, however if a supervision message is decoded (D6=1) then the microprocessor checks the RAM buffer which contains the data received at reduced sensitivity. This data has been clocked into the buffer using the timing information derived from the message on the high sensitivity port. If the supervision message in the buffer correlates (is identical to) the message received on the high sensitivity port then the message is sent to the control panel. If the correlation is not exact then this particular supervision message fails and is not sent to the control panel. Thus alarm (non-supervision) messages are received at full sensitivity, and all supervision messages are subject to an additional threshold to ensure adequate system margin.

This method does not rely for its success on multiple supervision or alarm messages to be sent at each alarm event, nor is this method adversely effected by multiple transmissions.

Those skilled in the art will recognize that depending on signal traffic probability, it may be necessary to provide sufficient RAM in order to buffer several low sensitivity messages for comparison with the high sensitivity counterpart.

Figure 3:
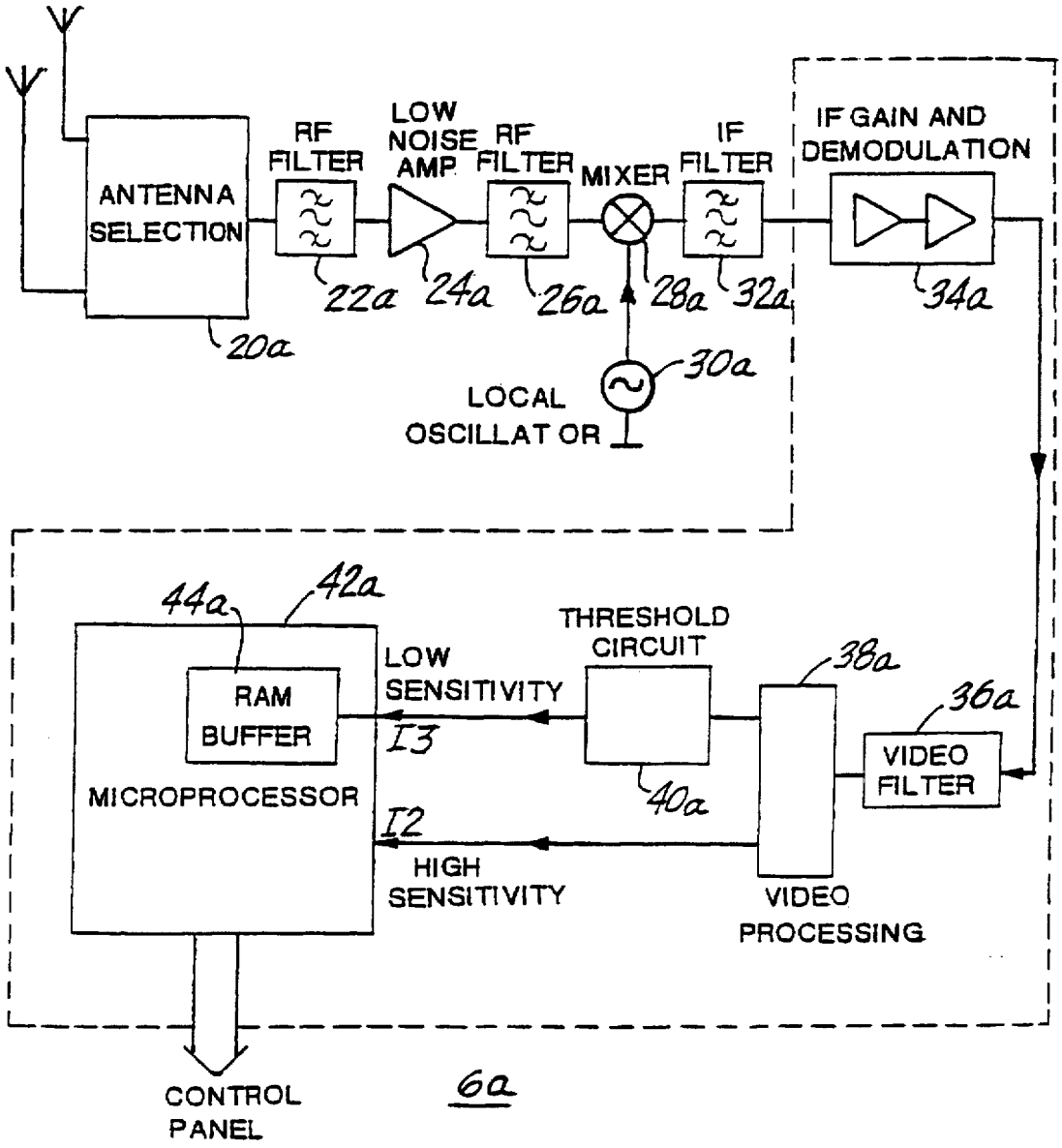
FIG. 3 is a block diagram of the receiver/control unit according to the preferred embodiment of the present invention.

FIG. 3 illustrates the circuit block diagram for the receiver/control unit 6 of the present invention. The receiver comprises an antenna selection circuit 20, an RF filter 22, a low noise amplifier 24, a second RF filter 26, a mixer 28, a local oscillator 30, an IF filter 32, an IF gain and demodulation circuit 34, and a video filter 36, which are all well known in the art of RF receivers. In addition, a demodulated baseband video signal is fed from the video filter 36 to a video processing circuit 38 and threshold circuit 40 which function to provide two outputs which have been subjected to different sensitivity thresholds. These data outputs are connected to two input ports of a microprocessor 42. The reduced sensitivity port is followed by an adequately sized buffer 44 to store the received data should the data be from a supervision signal and further correlation is required.

Figure 4:
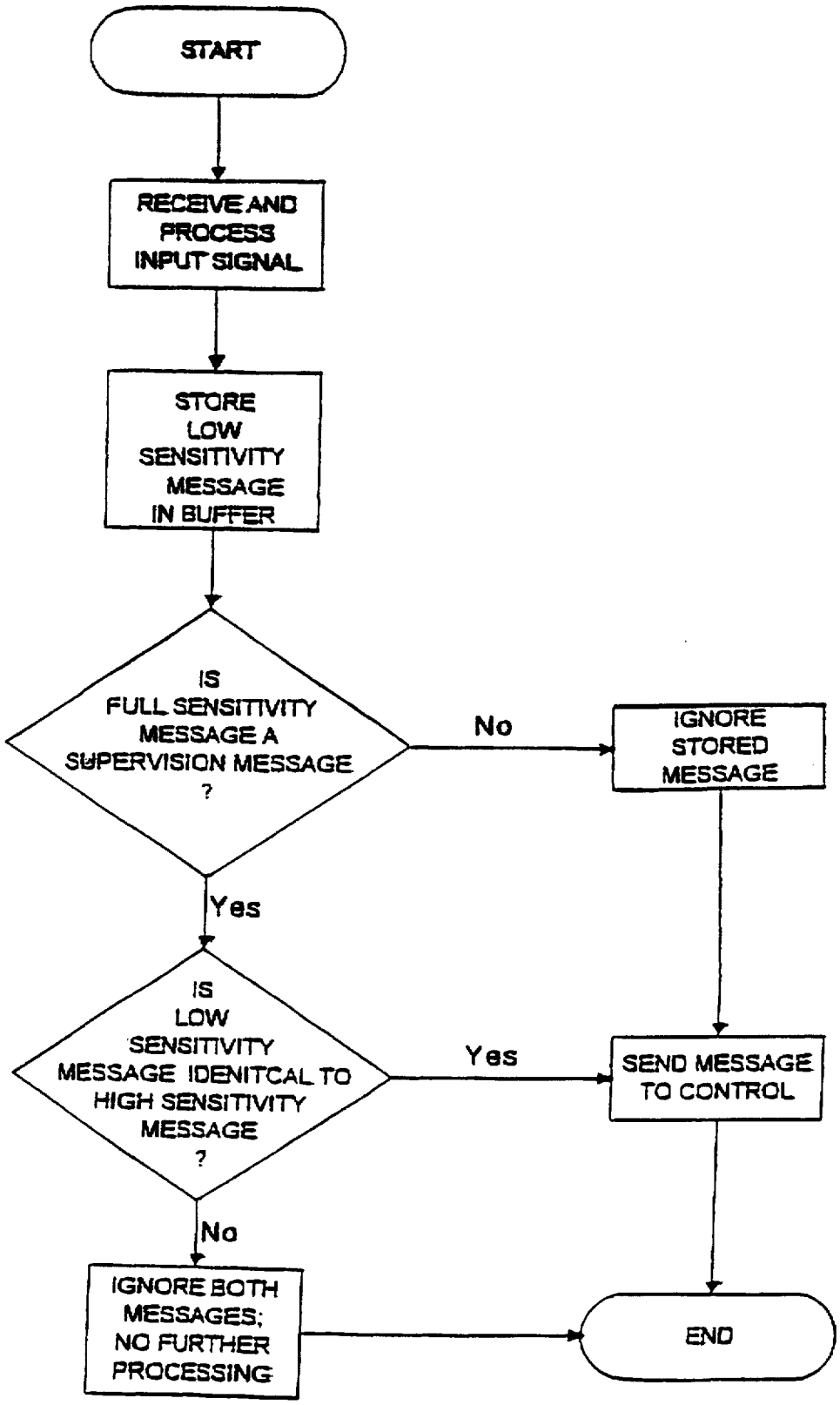
FIG. 4 is a flow chart of the operation of the preferred embodiment of the present invention.

Reference is now made to the flowchart of FIG. 4. The input signal is received and processed by the aforementioned components, and two data signals are derived; one at full, or normal receiver sensitivity, which is input to the microprocessor at port I2, and a second signal at reduced sensitivity, which is input to the microprocessor at port I3. The low sensitivity data message is stored in the RAM buffer 44. Concurrently, the microprocessor examines the D6 bit of the full sensitivity signal input at I2. If it is determined to be a non-supervision signal, then the reduced sensitivity data message stored in the RAM 44 is ignored, and the full sensitivity message from I2 is sent to the control. If, however, it is determined that the full received data message is a supervision type, then the microprocessor 42 compares the low sensitivity message stored at RAM 44 with the full sensitivity message, and if they are correlated, then the test has passed and the message is sent to the control. If however, the signals are not found to be correlated, then they are ignored, the test is considered to have failed, and the control is not provided with information that the supervision message were received.

In the preferred embodiment, correlation of the reduced sensitivity supervision signal and full sensitivity supervision signal is found when the two signals match identically. However, it is contemplated that there may be a degree of variance tolerable in a given system, and this may be designed into the comparison routine if desired.

The preferred embodiment has been described with reference to a system wherein a single message is transmitted at each transmission event and includes in the message a specific bit to designate a supervision message. Those skilled in the art will recognize that a message is often repeated to improve probability of reception and in addition a specific supervision bit may not be included. In this type of system a supervision transmission may be differentiated from an alarm transmission by the number of repeats of each message. There are regulatory requirements that a supervision message be repeated less often than an alarm message.

In these cases, the system described in the present invention will discern whether a message is a supervision type by counting the number of repeats of a received message before deciding whether or not to perform the comparison of low sensitivity and high sensitivity messages.

Figure 5:
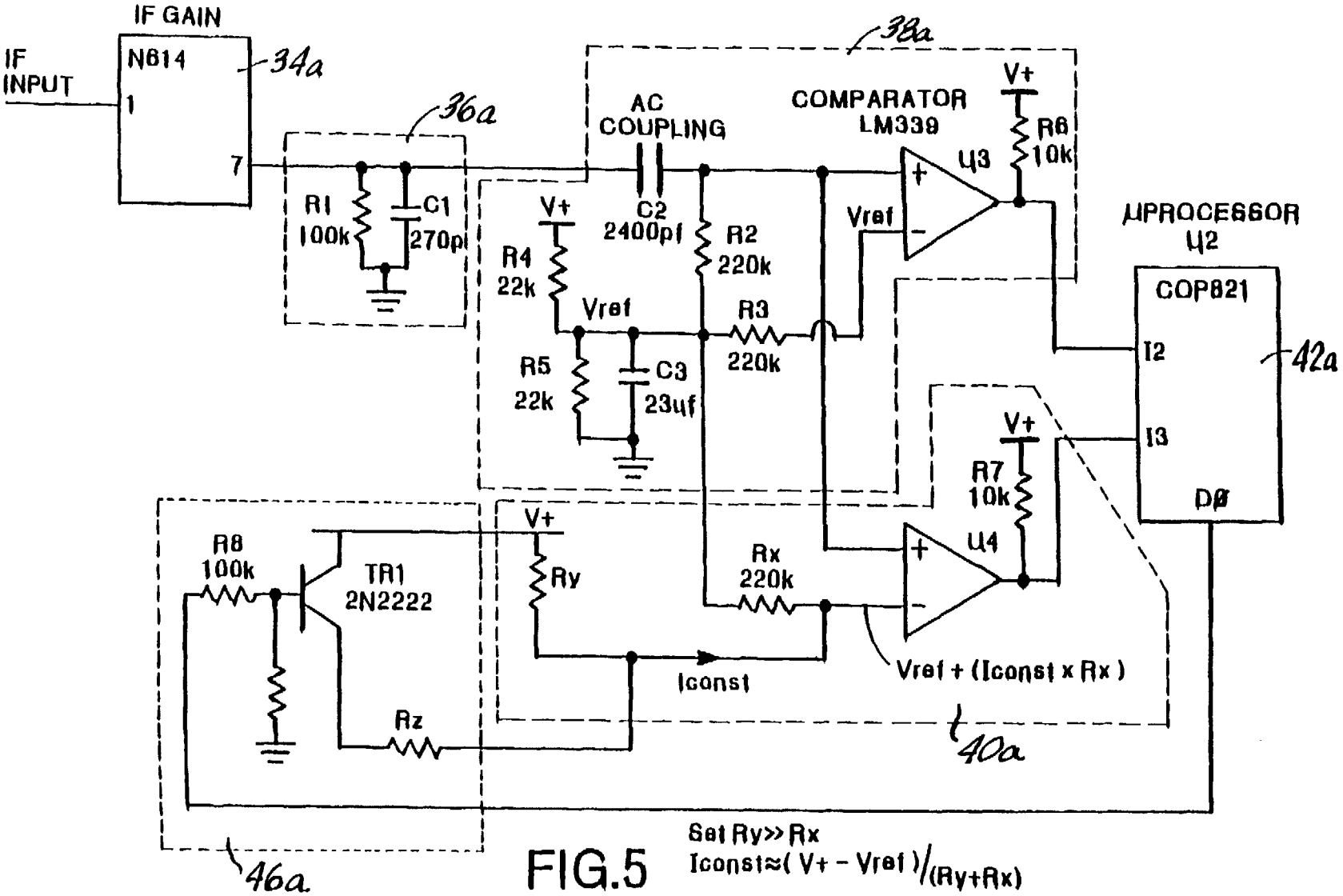
FIG. 5 is a detailed schematic of the processing portion of the block diagram of FIG. 3.

FIG. 5 illustrates the detailed schematic of the dotted line portion of FIG. 3. IF/demodulator integrated circuit 34, which in the preferred embodiment is a Philips NE614, utilizes the IF input signal and provides at its output a demodulated data signal to the low pass filter 36 formed by R1 and C1. The low pass filter 36 reduces the noise content of the video output signal. The filtered video signal is then AC coupled via capacitor C2 to the non-inverting inputs of the U3 and U4 comparators (LM339), which quantize the signal to a logic level suitable for input to the microprocessor 42. The combination of R4 and R5 form a voltage divider, which sets a slicing level for the reference voltage applied to the inverting input to the U3 comparator. Capacitor C3 provides an AC ground for the U3 comparator reference input.

The reference voltage applied to the inverting input on comparator U4 is modified by means of injection of additional current via resistor Ry. Thus, the reference voltage to U4 is offset by an amount determined by the values of Rx and Ry. Typically, Ry will be much larger than Rx or may be replaced by a true current source.

The output signals of each comparator U3, U4 are input to the microprocessor 42 input ports I2 and I3, respectively. The microprocessor in the preferred embodiment is a COP881 available from National Semiconductor. In particular, the output from U3 is fed to port I2 of the microprocessor, and is the normal sensitivity signal. The output from U4, which has been subjected to a higher comparison threshold than that at U3, is fed to port I3 of the microprocessor. This represents the low sensitivity input signal, which is stored in an internal RAM 44 for subsequent comparison if desired, as described above.

The microprocessor 42 may optionally control the threshold applied to U4 with a transistor switch TR1 and Rz, as shown in the optional control circuit of FIG. 5. When desired, the threshold voltage applied to the inverting input of comparator U4 may be varied by programming an appropriate data bit D0. When D0 is a low logic level, then the transistor TR1 is in the off state, and the threshold applied to U4 is unchanged. When, however, the D0 bit is set to a high logic level, then the transistor TR1 is turned on, and the reference voltage at U4 is varied in accordance with the value of the resistor Rz. Thus, the threshold for analyzing supervision signals as described herein may be varied via software control, and may be varied for any particular data message received from a transmitter. This may be expanded even further, for example by utilizing multiple control circuits 46 in parallel connection to the reference voltage input of U4. The resistor Rz on each additional control circuit may vary, and each individual control circuit 46 may be controlled by a different bit output from the microprocessor 42 (e.g. D1, D2, etc.). As such, a graduated threshold may be available for use with different environments by programming the appropriate bit to control the desired control circuit 46 and change the reference voltage accordingly.

It may be desired to only perform the automatic self-test functions of the present invention as herein described on certain remote devices rather than on each one. That is, regulatory requirements may only mandate that life safety devices or applications be tested in this manner, while other devices in the system need not meet such rigorous communications standards. In such a system, the processing circuitry and software is provided with further intelligence in order to determine which supervision messages are to undergo receiver parameter modification. This may be accomplished by designating a flag bit in the message as a test/no-test bit, wherein a logic true indicates that the transmission margin be tested, and a logic false indicates that he test need not be done. Alternatively, the processor may implement a look-up table programmed with the identity of each device which is to undergo the transmission margin test, and thus utilize the device identification code to access the table and process the message accordingly.

Thus while the particular embodiments of the present invention have been shown and described, various modifications will be apparent to those skilled in the art, and therefore it is not intended that the invention be limited to the disclosed embodiment or to details thereof and departures may be made therefrom within the spirit and scope of the present invention.

I claim:

1. In a communications system comprising a plurality of remote transmitting devices and a receiving station having a receiver associated therewith, each of said remote transmitting devices capable of transmitting a supervision signal and a non-supervision signal, a method for automatically testing the communications system comprising the steps of:

a) receiving at said receiving station a signal from a transmitting device;

b) processing said received signal at a first sensitivity level and providing a first output signal representative thereof;

c) processing said received signal at a second sensitivity level and providing a second output signal representative thereof, said second sensitivity level being lower in magnitude than said first sensitivity level;

d) determining if said received signal is a supervision signal or a non-supervision signal by analyzing said first output signal;

e) when said received signal is determined to be a supervision signal, then performing the steps of:

i) determining if said second output signal is correlated to said first output signal;

ii) subsequently processing said first output signal as being part of a validly received supervision signal when said second output signal is determined to be correlated to said first output signal; and iii) not subsequently processing said first output signal as being part of a validly received supervision signal when said second output signal is determined to be uncorrelated to said first output signal; and f) when said received signal is determined to be a non-supervision signal, then subsequently processing said first output signal as being art of a validly received non-supervision signal.

2. The method of claim 1 wherein said transmitting devices and said receiver communicate with electromagnetic wave transmission.

3. The method of claim 2 wherein said electromagnetic wave transmission is radio frequency wave transmission.

4. The method of claim 1 wherein said second output signal is determined to be correlated to said first output signal when they are identical to each other.

5. The method of claim 1 wherein said communications system is an alarm system, at least one of said remote transmitting devices is associated with an alarm sensor, and wherein said non-supervision signal from said transmitting device associated with an alarm sensor is an alarm signal comprising alarm messages encoded with alarm sensor data.

6. A self-testing data communications system comprising a) a plurality of remote devices, each of said remote devices comprising means for transmitting supervision signals and non-supervision signals;

b) a receiving station comprising:

i) means for receiving said supervision signals and said non-supervision signals;

ii) first processing means for providing at a first sensitivity level a first output signal representative of said received signal;

iii) second processing means for providing at a second sensitivity level a second output signal representative of said received signal, said second sensitivity level being lower in magnitude than said first sensitivity level;

iv) means for determining if said received signal is a supervision signal or a non-supervision signal; and v) means for comparing said first output signal to said second output signal to determine if they are correlated.

7. The communications system of claim 6 wherein said first output signal is further processed by said receiving station as a successfully received supervision signal when said comparison means indicates that said first output signal and said second output signal are correlated.

8. The communications system of claim 6 wherein said first output signal is not further processed by said receiving station as a successfully received supervision signal when said comparison means indicates that said first output signal and said second output signal are not correlated.

9. The communications system of claim 6 wherein said first output signal is determined to be correlated to said second output signal when they are identical to each other.

10. The communications system of claim 6 wherein said remote devices and said receiving means communicate by electromagnetic wave transmission.

11. The communications system of claim 10 wherein said electromagnetic wave transmission is radio frequency wave transmission.

12. The communications system of claim 6 wherein at least one of said remote devices is associated with an alarm sensor.

13. A receiving station for use in a data communications system comprising a plurality of remote devices, each of said remote devices having a transmitter for transmitting supervision signals and non-supervision signals, said receiving station comprising:

a) means for receiving said supervision signals and said non-supervision signals;

b) first processing means for providing at a first sensitivity level a first output signal representative of said received signal;

c) second processing means for providing at a second sensitivity level a second output signal representative of said received signal, said second sensitivity level being lower in magnitude than said first sensitivity level;

d) means for determining if said received signal is a supervision signal or a non-supervision signal; and e) means for comparing said first output signal to said second output signal to determine if they are correlated.

* * * * *

UNITED STATES PATENT AND TRADEMARK OFFICE

CERTIFICATE OF CORRECTION

PATENT NO. : 5,748,079

DATED : May 5, 1998

INVENTOR(S) : Kenneth L. Addy

It is certified that error appears in the above-identified patent and that said Letters Patent are hereby corrected as shown below:

Column 8, line 55, "art" should be changed to --part--.

Signed and Sealed this

Twenty-third Day of June, 1998

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,748,079

DATED : May 5, 1998

INVENTOR(S) : Kenneth L. Addy

It is certified that error appears in the above-identified patent and that said Letters Patent is hereby corrected as shown below:

In column 1, line 14 in the section entitled "Cross Reference to Related Application" the word "Jun." should be changed to --July--

Signed and Sealed this

First Day of September, 1998

Bruce Lehman

*Attest:*

BRUCE LEHMAN

*Attesting Officer*

*Commissioner of Patents and Trademarks*